US006472832B1

(12) United States Patent
Kimiya et al.

(10) Patent No.: US 6,472,832 B1
(45) Date of Patent: Oct. 29, 2002

(54) CATHODE RAY TUBE

(75) Inventors: Junichi Kimiya, Fukaya (JP); Shigeru Sugawara, Saitama (JP); Syunji Ookubo, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 285 days.

(21) Appl. No.: 09/620,585

(22) Filed: Jul. 20, 2000

Related U.S. Application Data

(63) Continuation of application No. PCT/JP99/06409, filed on Nov. 17, 1999.

(30) Foreign Application Priority Data

Nov. 20, 1998 (JP) ..... 10-330799

(51) Int. Cl.[7] ..... G09G 1/04

(52) U.S. Cl. ..... 315/382; 315/15; 313/414; 313/449

(58) Field of Search ..... 315/15, 17, 370, 315/382, 382.1, 368.15; 313/412–415, 428, 446, 449

(56) References Cited

U.S. PATENT DOCUMENTS

| | | | | | |
|---|---|---|---|---|---|
| 4,591,760 | A | * | 5/1986 | Kimura | 313/449 |
| 5,519,290 | A | * | 5/1996 | Sugawara et al. | 315/15 |
| 5,539,285 | A | | 7/1996 | Iguchi et al. | 315/382 |
| 5,694,004 | A | * | 12/1997 | Kimiya et al. | 313/412 |
| 6,236,152 | B1 | * | 5/2001 | Kimiya et all. | 313/412 |

FOREIGN PATENT DOCUMENTS

| | | | |
|---|---|---|---|
| EP | 2238163 | A * | 5/1991 |
| JP | 64-38947 | | 2/1989 |
| JP | 7-147146 | | 6/1995 |
| JP | 8-148095 | | 6/1996 |
| JP | 8-162041 | | 6/1996 |
| JP | 8-227671 | | 9/1996 |

* cited by examiner

*Primary Examiner*—Haissa Philogene
(74) *Attorney, Agent, or Firm*—Oblon, Spivak, McClelland, Maier & Neustadt, P.C.

(57) ABSTRACT

A sixth grid, which is part of a main electron lens section, is made up of a first anode, an auxiliary electrode and a second anode. A fifth grid is applied with an intermediate voltage. The first and second anodes are applied with an anode voltage. An intermediate electrode and the auxiliary electrode are applied with a voltage whose level is between the levels of the intermediate voltage and anode voltage.

8 Claims, 8 Drawing Sheets

CATHODE RAY TUBE

CROSS REFERENCE TO RELATED APPLICATIONS

This is a continuation of application No. PCT/JP99/06409, filed Nov. 17, 1999.

This application is based upon and claims the benefit of priority from the prior Japanese Patent Application No. 10-330799, filed Nov. 20, 1998, the entire contents of which are incorporated herein by reference.

BACKGROUND OF THE INVENTION

The present invention relates to a cathode ray tube, and more particularly to a cathode ray tube provided with an electron gun assembly that suppresses resolution deterioration on the periphery of a screen.

An in-line color cathode ray tube of self-convergence type is provided with an in-line electron gun assembly for emitting three in-line electron beams traveling in the same horizontal plane. One of the beams is a center beam, and the others are side beams traveling along the center beam. The cathode ray tube is also provided with a deflection yoke for generating a non-uniform magnetic field, with which the electron beams emitted from the electron gun assembly are deflected. The three electron beams emitted from the electron gun assembly are converged by the main lens portion incorporated in the electron gun assembly and then self-converge on the entire screen by the action of a non-uniform magnetic field. This magnetic field is made by a pincushion-type horizontal deflecting magnetic field and a barrel-type vertical magnetic field.

Electron beams 6 passing through this non-uniform magnetic field undergo astigmatism. As shown in FIG. 1A, each electron beam is applied with the forces acting in the directions of arrows 11H and 11V by the pincushion-type magnetic field 10. When the electron beam 6 falls on the periphery of the phosphor screen, it forms a distorted beam spot 12 on the phosphor screen, as shown in FIG. 1B. This distortion is due to the deflection aberration that causes the electron beam 6 to excessively focus in the vertical direction, i.e., in the V-axis direction.

Hence, the beam spot 12 includes a halo portion 13A extended in the vertical direction and a core portion 13B extended in the horizontal direction, i.e., in the H-axis direction. This deflection aberration becomes significantly marked in accordance with an increase in the size of the tube or the deflection angle thereof, and results in a marked deterioration of the resolution on the periphery of the phosphor screen.

In order to provide a solution to the resolution deterioration that is due to the deflection aberration, a high-performance electron gun assembly has been developed. This electron gun assembly corrects the deflection aberration on the periphery of the screen by varying the lens power of an electron lens inside the electron gun assembly in accordance with the amount of deflection of an electron beam directed toward the screen periphery.

An example of such an electron gun assembly is described in Jpn. Pat. Appln. KOKAI Publication No. 64-38947. This electron gun assembly comprises a first grid G1, a second grid G2, a third grid G3, a fourth grid G4, a fifth grid G5, a first intermediate electrode GM1, a second intermediate electrode GM2, and a sixth grid G6. These elements are arranged from the side of a cathode K(R,G,B) to the side of a phosphor screen in the order mentioned, as shown in FIG. 2. The third to sixth grids are applied with voltages shown in FIG. 3.

Referring to FIG. 3, the solid line in the graph represents the voltage that is used in the non-deflection mode, i.e., in the mode wherein an electron beam is focused on the center of the phosphor screen. The broken line in the graph represents the voltage that is used in the deflection mode, i.e., in the mode wherein an electron beam is focused on the periphery of the phosphor screen. The axis of abscissa Z represents the positions of the electrodes arranged on the tube axis, which is substantially the central axis of a cylindrical neck portion in which the electron gun assembly is arranged. The increasing direction of the Z axis is a direction approaching the phosphor screen, while the decreasing direction is a direction approaching the cathode. The axis of ordinate V represents the voltage levels applied to the grids.

As shown in FIG. 3, the third and fifth grids are applied with a dynamic focusing voltage obtained by superimposing a variation voltage on a predetermined DC voltage Vf. The variation voltage varies in accordance with the amount of deflection of an electron beam.

When the voltage described above is applied to each grid, a quadrupole lens section QL2 is formed between the fifth grid G5 and the first intermediate electrode GM1, a cylindrical lens section CL between the fifth grid G5 and the sixth grid G6, and a quadrupole lens section QL1 between the second intermediate electrode GM2 and the sixth grid G6. The quadrupole lens section QL2 includes a vertical-direction component with a relatively focusing function and a horizontal-direction component with a relatively divergent function. The quadrupole lens section QL1 includes a vertical-direction component with a relatively divergent function and horizontal-direction component with a relatively focusing function. The main lens section ML of the electron gun assembly is constituted by the quadrupole lens sections QL1 and QL2 and the cylindrical lens section CL.

In the deflection mode, the voltages applied to the third and fifth grids are raised from the level indicated by the solid line to the level indicated by the broken line, as shown in FIG. 3. As shown in FIG. 4B, the power of the quadrupole lens section QL2 and that of the cylindrical lens section CL are suppressed. As a result, the diverging effect is maintained only in the vertical direction, with the focusing effect in the horizontal direction being unchanged. In this manner, an electron beam is prevented from being excessively focused in the vertical direction by the deflecting magnetic field.

However, the dynamic focusing voltage, which is synchronously related to the-horizontally-deflecting magnetic field, may fluctuate in synchronism with a deflecting frequency of 15 kHz or higher. When this fluctuation occurs, the capacitance between the fifth grid and the first intermediate electrode, that between the first and second intermediate electrodes and that between the second intermediate electrode and the sixth grid serve to conduct AC components. As a result, the first and second intermediate electrodes are applied with part of the dynamic focusing voltage acting in the horizontal direction. This being so, not only the quadrupole lens section QL2 and the cylindrical lens section CL but also the quadrupole lens section QL1 vary in lens power.

Owing to this, the divergence in the vertical direction may not be sufficient. In the case of a self-convergence type, the focusing force in the horizontal direction may abate though it must not. As a result, an electron beam spot on the periphery of the phosphor screen is excessively focused in the vertical direction, resulting in a halo portion, and is insufficiently focused in the horizontal direction.

To solve this problem, Jpn. Pat. Appln. KOKAI Publication No. 7-147146 proposes such an electron gun assembly as is shown in FIG. 5. The fifth grid of this electron gun assembly is made up of a first segment G51 and a second segment G52. As indicated by the broken lines in FIG. 6, a third grid and a second segment G52 are applied with a voltage that rises in accordance with the amount of deflection of an electron beam. As indicated by the broken lines in FIG. 7, therefore, a quadrupole lens QL3 having a diverging vertical component and a focusing horizontal component is formed between the first segment G51 and the second segment G52 in the deflection mode only.

If the auxiliary quadrupole lens section QL3 is formed, however, the lens main plane, namely, the imaginary lens center used for focusing electron beams on the phosphor screen (i.e., the point where the path of a beam emitted from the cathode and the path of a beam incident on the phosphor screen cross each other) is shifted.

In the non-deflection mode, the lens main plane in the vertical direction is located substantially in the center of the main lens section ML. In the deflection mode wherein the quadrupole lens section QL3 is used, the lens main plane in the vertical direction is shifted from the main lens section ML to the phosphor screen, i.e., in the increasing direction of the Z axis, since an electron beam is diverged in the vertical direction by the vertical-direction component of the quadrupole lens section QL3.

In the non-deflection mode, the lens main plane in the horizontal direction is located substantially in the center of the main lens section ML, just like the lens main plane in the vertical direction. In the deflection mode wherein the quadrupole lens section QL3 is used, the lens main plane in the horizontal direction is shifted from the main lens section ML to the cathode, i.e., in the decreasing direction of the Z axis, since an electron beam is focused by the horizontal-direction component of the quadrupole lens section QL3.

Owing to this movement of the lens main plane, in the phosphor screen periphery on which a deflected electron beam is focused, the angular magnification as viewed in the vertical direction is smaller than the angular magnification as viewed in the horizontal direction. As a result, the beam spot formed by the electron beam is not only influenced by the deflecting magnetic field generated by the deflecting yoke but also distorted in such a manner that it is elongated more in the horizontal direction than in the vertical direction.

On the periphery of the phosphor screen, the horizontal-direction diameter of the beam spot is very large, resulting in degradation in image quality. In addition, the vertical-direction diameter of the beam spot is very small, causing moire on the periphery.

In the case of a color cathode ray tube whose deflection angle is wide, the deflecting magnetic field inevitably includes a coma aberration component, and those components of the deflecting magnetic field which have effects on the lens function vary. In other words, the focusing effects which the deflection yoke lens may have on the side beams vary. As shown in FIG. 14, therefore, the beam spot diameters markedly differ between the right and left portions of the screen. Even if an adequate dynamic voltage is applied to the focusing electrodes, the electron beam spots on the right and left portions of the screen cannot be properly focused.

As described above, in the electron gun assembly disclosed in Jpn. Pat. Appln. KOKAI Publication No. 64-38947, the AC components of the dynamic focusing voltage applied to the fifth grid G5 are transmitted to the first and second intermediate electrodes through the capacitances between the electrodes of the main lens section ML. As a result, the lens power of the quadrupole lens section QL1 formed between the second intermediate electrode and the sixth grid varies. Since the diverging effect is insufficient in the vertical direction, and the focusing effect is insufficient in the horizontal direction, a beam spot formed on the periphery of the phosphor screen inevitably includes a halo portion which is due to the excessive focus in the vertical direction. In addition, the beam spot is elongated in the horizontal direction due to the insufficient focusing effect in this direction.

An electron gun assembly that has solved this phenomenal problem is disclosed in Jpn. Pat. Appln. KOKAI Publication No. 7-147146. In the electron gun assembly described in this publication, an auxiliary quadrupole lens QL3 is formed on the cathode side of the main lens section ML in the deflection mode only. Owing to the operation of the quadrupole lens section QL3 in the deflection mode, the lens main plane as viewed in the vertical direction moves forward toward the screen, while the lens main plane as viewed in the horizontal direction moves backward toward the cathode. As a result, the lens power difference is caused between the vertical direction and the horizontal direction. Due to this difference, the beam spot is undesirably elongated in the horizontal direction.

In the case of a color cathode ray tube whose deflection angle is wide, the deflecting magnetic field inevitably includes a coma aberration component, and those components of the deflecting magnetic field which have effects on the lens function vary. In other words, the focusing effects which the deflection yoke lens may have on the side beams vary. As shown in FIG. 14, therefore, the beam spot diameters markedly differ between the right and left portions of the screen. Even if an adequate dynamic voltage is applied to the focusing electrodes, the electron beam spots on the right and left portions of the screen cannot be properly focused.

BRIEF SUMMARY OF THE INVENTION

The present invention has been made to solve the above problems and is intended to provide a cathode ray tube which prevents or suppresses the distortion of a beam spot shape on the periphery of a screen and which therefore provides a reliable resolution at any portion of the screen.

As described above, the lens main plane as viewed in the horizontal direction moves backward toward the cathode, while the lens main plane as viewed in the vertical direction moves forward toward the screen. The angular magnification difference between the horizontal and vertical directions elongates an electron beam in the horizontal direction. This horizontal elongation, i.e., the angular magnification difference, becomes more marked in accordance with an increase in the intensity of the third quadrupole lens QL3. This phenomenon is attributed to the fact that the vertical and horizontal movements of the main lens plane are influenced by the focusing and diverging effects of the third quadrupole lens QL3. As described above, the lens operation of the third quadrupole lens QL3 is intended to compensates for the insufficient diverging effect of the vertical direction and the insufficient focusing effect of the horizontal direction, which are due to those AC components of the dynamic voltages which are superimposed on the voltages applied to the intermediate electrodes of the main lens section. As can be seen from this, if the superposing effects which the dynamic voltages may have on the intermediate electrodes can be suppressed, the lens effect of the third quadrupole lens QL3 need not be intense. In other words, the lens main plane does not move for a long distance in the horizontal and vertical directions, and the horizontal elongation which the electron beam spots may suffer on the periphery of the screen due to the angular magnification difference can be suppressed.

Hence, the elongation of an electron beam on the periphery of the screen can be suppressed by reducing the superposing effects which the dynamic voltages may have on the intermediate electrodes.

According to the present invention, the means for reducing the superposing effects which the dynamic voltages may have on the intermediate electrodes GM1 and GM2 is realized by the structure described below.

FIG. 9A shows the electrode structure and wiring pattern of the main lens section of the electron gun assembly that is applied to a cathode ray tube of the present invention. FIG. 9B shows an equivalent circuit of the main lens section shown in FIG. 9A.

A focusing electrode G52 is applied with an intermediate focusing voltage which may vary in synchronism with a deflecting magnetic field. A first anode G61 is applied with an anode voltage. Between these electrodes, at least one intermediate electrode GM is arranged, and the voltage applied thereto is higher than the intermediate focusing voltage and lower than the anode voltage. The three electrodes constitute a main lens section ML of an electric field expansion type. At least one auxiliary electrode G62 is arranged between the first anode G61 of the electric field expansion type main lens section ML and a second anode G63. This second anode G63 is located closer to the screen than the first anode 61, as viewed in the traveling direction of electron beams, and is applied with an anode voltage. The auxiliary electrode 62 and the intermediate electrode GM are electrically connected together.

In the descriptions given above, reference was made to the case where there is only one intermediate electrode GM, for the sake of simplicity. Needless to say, this in no way restricts the present invention, and a plurality of intermediate electrode may be provided. Although not illustrated in the electrode diagram, a third quadrupole lens QL3 is arranged on the cathode side of the focusing electrode G52.

In the case the electrode structure shown in FIG. 10A, the equivalent circuit is inevitably such as that shown in FIG. 10B according to the prior art. As can be seen from the equivalent circuit in FIG. 10B, the superposing voltage Vm applied to the intermediate electrode GM can be calculated by $Vm=C/2C\cdot Vd=\frac{1}{2}\cdot Vd$, where the AC component of the dynamic voltage is Vd. Hence, 50% of the AC component Vd applied to the focusing electrode G52 is superimposed on the voltage applied to the intermediate electrode GM (on the condition that the capacitance between the focusing electrode G52 and the intermediate electrode GM is equal to that between the intermediate electrode GM and the anode G6). In contrast to this, the structure according to the present invention has an electrode structure such as that shown in FIG. 9A, and the equivalent circuit thereof is such as that shown in FIG. 9B. In this case, the superposing voltage Vm applied to the intermediate electrode GM can be calculated by $Vm=C/4C\cdot Vd=\frac{1}{4}\cdot Vd$. Hence, 25% of the AC component Vd applied to the focusing electrode G52 is superimposed on the voltage applied to the intermediate electrode GM. In this manner, the structure of the present invention enables a reduction of superimposing voltage from 50% (prior art) to 25%.

In the prior art, 50% of the AC component of the dynamic voltage is superimposed on the voltage applied to the intermediate electrode GM of the main lens section, and this result in an insufficient diverging effect in the vertical direction and an insufficient focusing effect in the horizontal direction. To compensate for this insufficiency, the third quadrupole lens QL3 is used for moving the lens main plane in the horizontal direction backwards towards the cathode, and for moving the lens main plane in the vertical direction forwards towards the screen. Although an electron beam is horizontally elongated due to the angular magnification difference, this horizontal elongation can be reduced to half.

As shown in FIG. 11B, an asymmetric lens having a diverging effect in the vertical direction and a focusing effect in the horizontal direction is formed. It is formed between a first anode G61, a second anode G63, and an auxiliary electrode G62 for forming a main lens section of an electric field expansion type. The second anode G63 is located closer to the screen than the first anode G61, as viewed in the traveling direction of electron beams, and is applied with an anode voltage. The auxiliary electrode G62 is located between the first and second anodes G61 and G63 and is electrically connected to an intermediate electrode GM. The asymmetric lens is arranged in the neighborhood of the DY lens of a deflecting magnetic field.

FIG. 13A shows a lens state and an electron beam path of a case where an astigmatic lens is arranged in the neighborhood of the DY lens. FIG. 13B shows a lens state and an electron beam path of a case where an astigmatic lens is arranged at a position far away from the DY lens. In the Figures, "$\alpha$0" represents radiating angles at the electron beam forming section, and "$\alpha$1(V)" and "$\alpha$1(H)" represent angles of incidence at which a beam is incident on the screen. "LH" and "LV" indicate the positions of the lens main planes in the vertical direction (V) and the horizontal direction (H). Let us assume that the beam radiating angle in the horizontal direction is equal to that in the vertical direction (=$\alpha$0). When, in this case, the lens main plane positions are close to the cathode, the angles of incidence at which the beams fall on the screen are narrow, and the angular magnification is increased, accordingly. As a result, the electron beam spots projected on the screen are large. Conversely, when the lens main plane positions are close to the screen, the angular magnification is decreased, and the electron beam spots are small.

The case where the astigmatic lens is arranged in the neighborhood of the DY lens (FIG. 13A) and the case where it is arranged at a position far away from the DY lens (FIG. 13B) will be compared with each other. Where the astigmatic lens is located close to the DY lens, as shown in FIG. 13A, the lens main plane of the combination of the astigmatic lens and the DY lens is somewhat shifted from the DY lens towards the screen in the vertical direction (V), as indicated by "LV", and is somewhat shifted from the astigmatic lens towards the cathode in the horizontal direction (H), as indicated by "LH." Accordingly, the diameter of an electron beam is greater in the horizontal direction than in the vertical direction. This phenomenon becomes more marked when the astigmatic lens is arranged at a position far away from the DY lens, as in the case shown in FIG. 13B. In this case, the main plane position (LV') as viewed in the vertical direction (V) is not shifted significantly. However, the main plane position (LH') as viewed in the horizontal direction (H) is greatly shifted towards the cathode, further increasing the beam diameter of the electron beam spot in the horizontal direction. As can be seen from this, the astigmatic lens arranged in the neighborhood of the DY lens is more advantageous than the astigmatic lens arranged far away from the DY lens in that an electron beam spot shape can be as circular as possible even on the periphery of the screen.

As described above, the asymmetric lens serves not only to suppress those components of the dynamic voltage which are superimposed on the voltages applied to the intermediate electrode of the main lens section, but also to produce a diverging effect in the vertical direction and a focusing effect in the horizontal direction in the neighborhood of the DY lens. Owing to the formation of such an asymmetric lens, the electron beam spot on the periphery of the screen is prevented from being excessively distorted in the horizontal direction (an excessive decrease in the vertical diameter and an increase in the horizontal diameter are prevented).

To solve the problems and achieve the purpose, claim 1 provides a cathode ray tube comprising:

an electron gun assembly including: an electron beam formation section for forming and emitting at least one electron beam; and a main electron lens section for accelerating the electron beam and focusing the electron beam on a screen; and a deflection yoke for generating a deflecting magnetic field, with which the electron beam emitted from the electron gun assembly is deflected to the screen in a horizontal direction and a vertical direction, the main electron lens section being an electric field expansion type lens including: a focusing electrode applied with a focusing voltage of a first level; an anode applied with an anode voltage of a second level higher than the first level; and at least one intermediate electrode arranged between the focusing electrode and the anode and applied with an intermediate voltage of a third level which is higher than the first level and lower than the second level, the anode including: a first anode; a second anode located closer to the screen than the first anode as viewed in the traveling direction of electron beams; and at least one auxiliary electrode interposed between the first anode and the second anode, the at least one auxiliary electrode and the at least one intermediate electrode being electrically connected to each other.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the cathode ray tube of the present invention will now be described with reference to the accompanying drawings.

The first embodiment of the present invention will be described first of all.

Figure 9A:
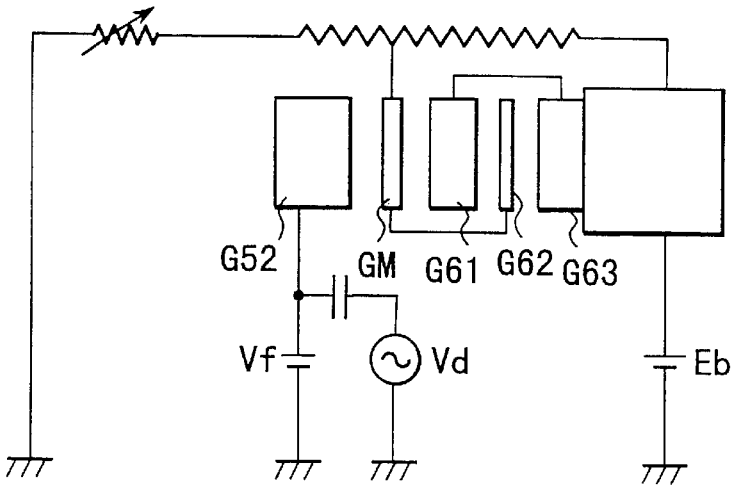
FIG. 9A schematically shows the structure of the main electronic lens section of an electronic gun assembly according to the present invention.
Figure 9B:
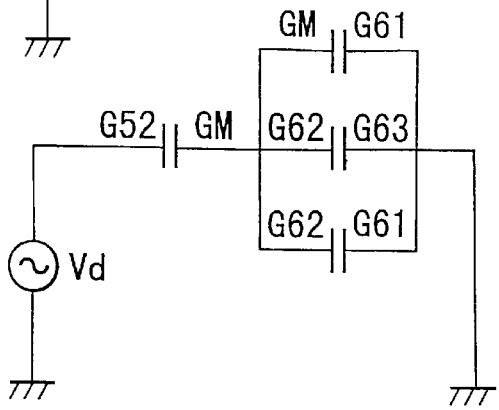
FIG. 9B shows an equivalent circuit of the main electron lens section shown in FIG. 9A, and FIG. 10A schematically shows the structure of the main electronic lens section of an electronic gun assembly according to the conventional art.

FIG. 9A shows the electrode structure and wiring pattern of the main lens section of the electron gun assembly that is applied to a cathode ray tube of the present invention. FIG. 9B shows an equivalent circuit of the main lens section shown in FIG. 9A.

As shown in FIG. 9A, a focusing electrode G52 is applied with an intermediate focusing voltage which may vary in synchronism with a deflecting magnetic field. A first anode G61 is applied with an anode voltage. Between these electrodes, one intermediate electrode GM is arranged, and the voltage applied thereto is higher than the intermediate focusing electrode and lower than the anode voltage. The three electrodes constitute a main lens section ML of an electric field expansion type. At least one auxiliary electrode G62 is arranged between the first anode G61 of the electric field expansion type main lens section ML and a second anode G63. This second anode G63 is located closer to the screen than the first anode G61, as viewed in the traveling direction of electron beams, and is applied with an anode voltage. The auxiliary electrode G62 and the intermediate electrode GM are electrically connected together.

Figure 10A:
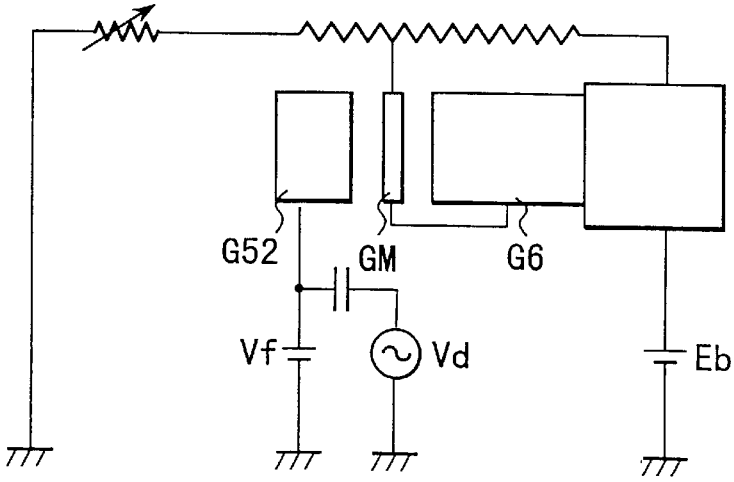
FIG. 10A (PRIOR ART)
FIG. 10B shows an equivalent circuit of the main electron lens section shown in FIG. 10A.
Figure 10B:
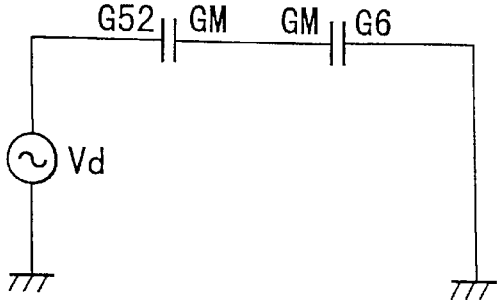
FIG. 10B (PRIOR ART)

In the case the electrode structure shown in FIG. 10A, the equivalent circuit is inevitably such as that shown in FIG. 10B according to the prior art. As can be seen from the equivalent circuit in FIG. 10B, the superposing voltage Vm applied to the intermediate electrode GM can be calculated by $Vm=C/2C\cdot Vd=\frac{1}{2}\cdot Vd$ (on the condition that the capacitances C of the gaps between the electrodes are equal). Hence, 50% of the AC component Vd applied to the focusing electrode G52 is superimposed on the voltage applied to the intermediate electrode GM (on the condition that the capacitance between the focusing electrode G52 and the intermediate electrode GM is equal to that between the intermediate electrode GM and the anode G6).

In contrast to this, the structure according to the present embodiment has an electrode structure such as that shown in FIG. 9A, and the equivalent circuit thereof is such as that shown in FIG. 9B. In this case, the superposing voltage Vm applied to the intermediate electrode GM can be calculated by $Vm=C/4C\cdot Vd=\frac{1}{4}\cdot Vd$ (on the condition that the capacitances C of the gaps between the electrodes are equal). Hence, 25% of the AC component Vd applied to the focusing electrode G5 is superimposed on the voltage applied to the intermediate electrode GM.

In this manner, the structure of the present embodiment enables a reduction of superimposing voltage from 50% (prior art) to 25%.

In the prior art, the AC component of the dynamic voltage is superimposed on the voltage applied to the intermediate electrode GM of the main lens section, and this results in an insufficient diverging effect in the vertical direction and an insufficient focusing effect in the horizontal direction. Although the third quadrupole lens is used for compensation for this insufficiency, its power need not be intense. In addition, the lens main plane in the horizontal direction is prevented from moving backwards towards the cathode, and the lens main plane in the vertical direction is prevented from moving forwards towards the screen. Although the angular magnification difference between the vertical and horizontal directions results in a horizontally elongated beam, this horizontal elongation can be suppressed.

The second embodiment of the present invention will now be described.

Figure 1A:
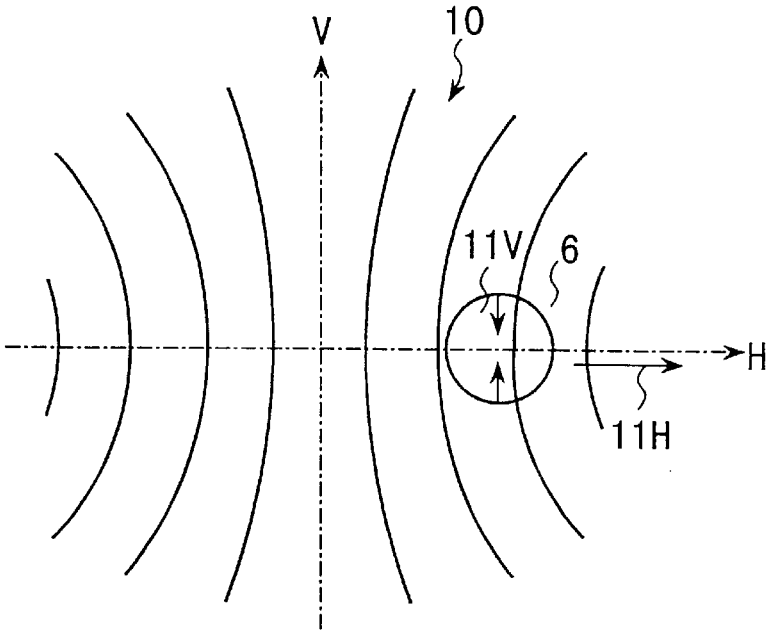
FIGS. 1A and 1B are views illustrating how a beam spot formed on the periphery of a phosphor screen is distorted.
Figure 1B:
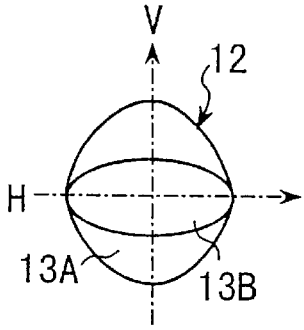
Figure 2:
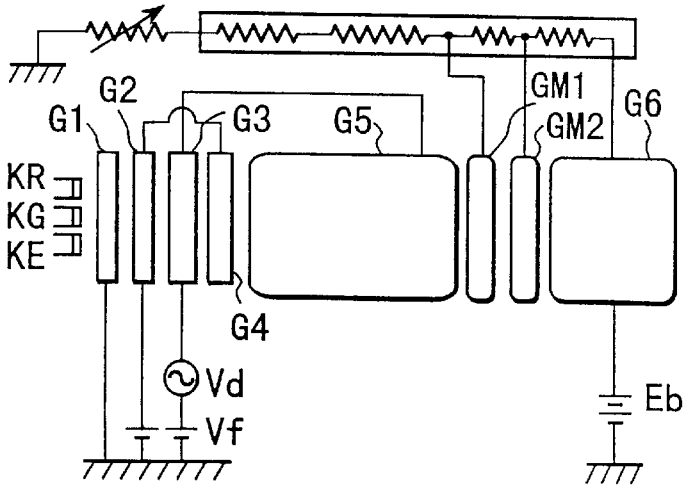
FIG. 2 (PRIOR ART)
FIG. 2 is a horizontal section view schematically showing an example of a conventional electron gun assembly.
Figure 3:
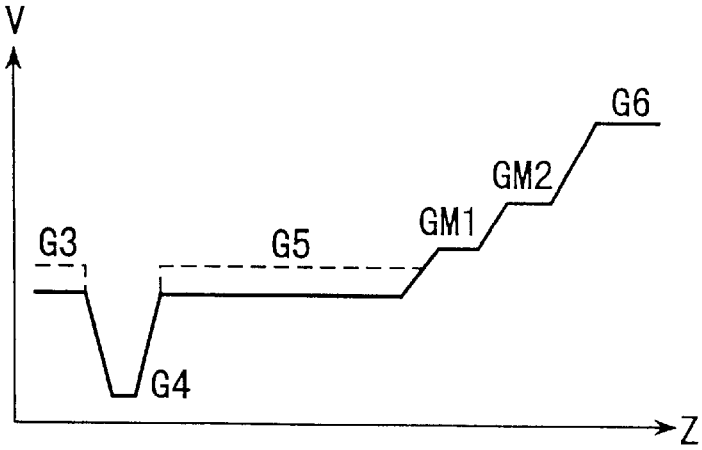
FIG. 3 (PRIOR ART)
FIG. 3 schematically illustrates voltage levels applied to major grids of the electron gun assembly shown in FIG. 2.
Figure 4A:
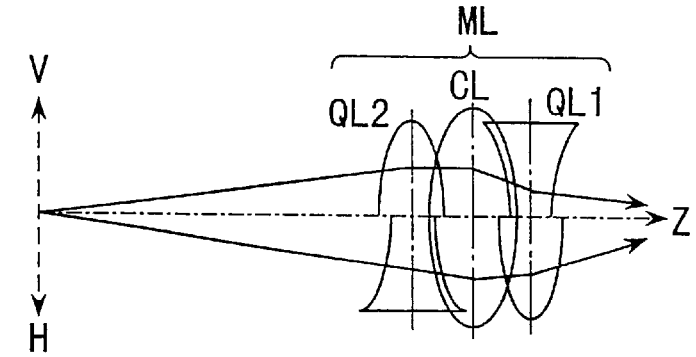
FIG. 4A (PRIOR ART)
FIGS. 4A and 4B illustrate how the main electron lens section functions in the deflection mode and the non-deflection mode.
Figure 4B:
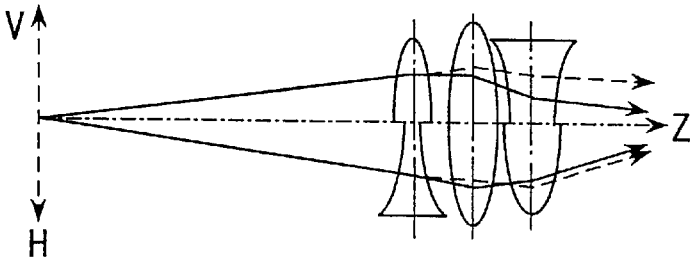
FIG. 4B (PRIOR ART)
Figure 5:
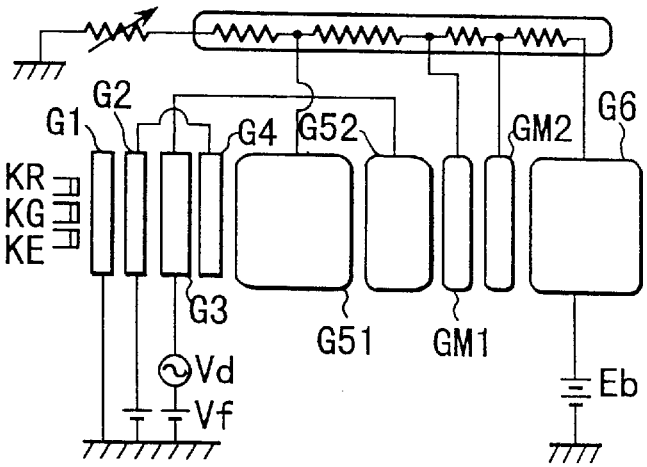
FIG. 5 (PRIOR ART)
FIG. 5 is a horizontal section view schematically showing an example of a conventional electron gun assembly.
Figure 6:
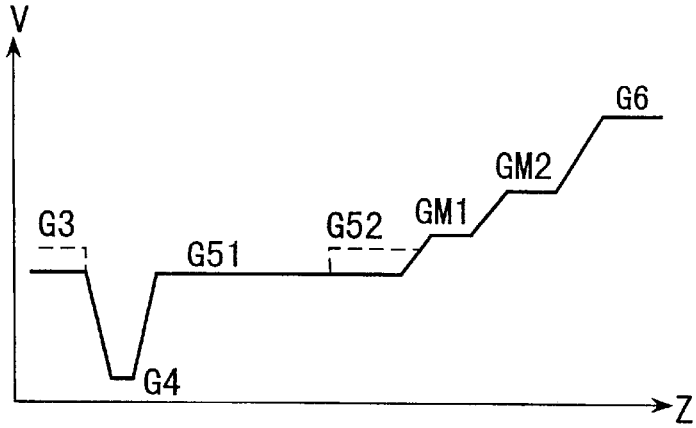
FIG. 6 (PRIOR ART)
FIG. 6 schematically illustrates voltage levels applied to major grids of the electron gun assembly shown in FIG. 5.
Figure 7:
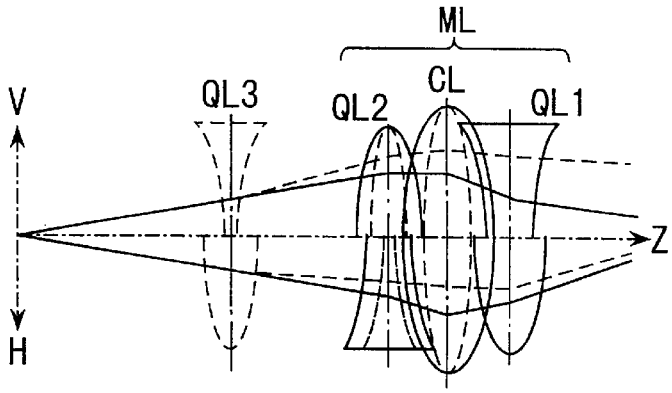
FIG. 7 (PRIOR ART)
FIG. 7 illustrates how the main electron lens section functions in the deflection mode and the non-deflection mode.
Figure 8:
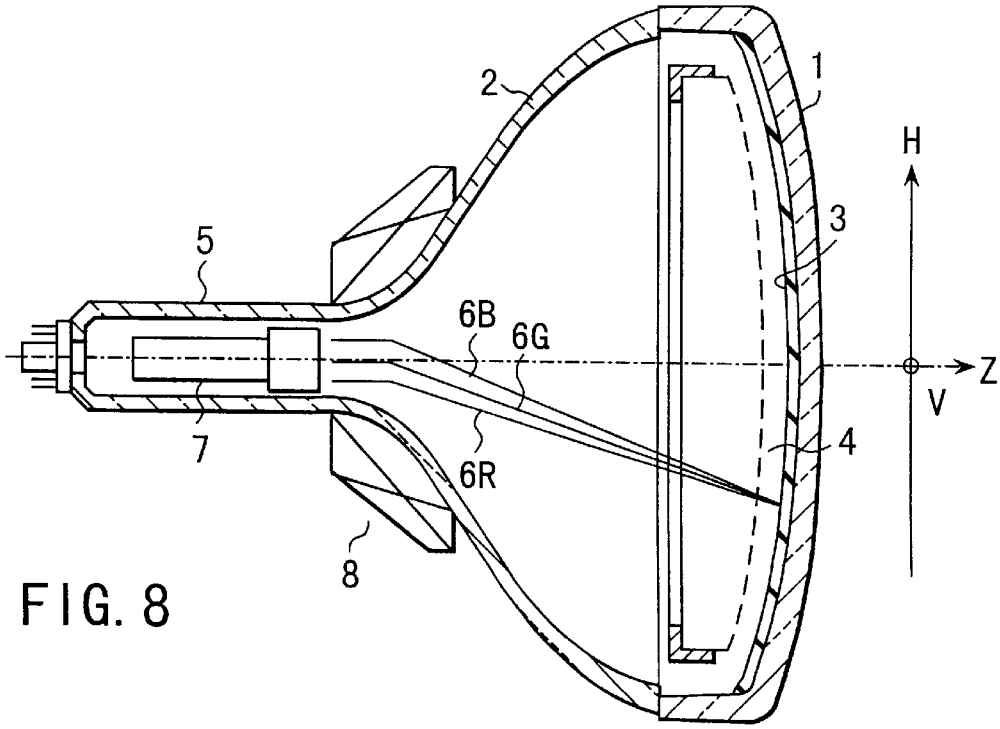
FIG. 8 is a horizontal section view schematically showing the structure of a color cathode ray tube, which is an embodiment of the cathode ray tube according to the present invention.

The cathode ray tube of the present invention can be embodied as an in-line color cathode ray tube of self-convergence type. As shown in FIG. 8, the color cathode ray tube comprises an envelope made up of a panel section 1 and a funnel section 2 integrally coupled to the panel section. A phosphor screen (target) 3 is provided on the inner surface of the panel section 1. The phosphor screen is made of three-color phosphor layers which are in the form of stripes or dots and emits blue, green and red colors. The panel section 1 contains a shadow mask 4 which faces the phosphor screen 3 and which has a large number of apertures.

The funnel section 2 has a neck portion 5, and an in-line electron gun assembly 7 is arranged in the neck portion 5. The electron gun assembly 7 emits three electron beams 6B, 6G and 6R which travel in the same horizontal plane. The electron beams are specifically a center beam and a pair of side beams traveling along the center beam. The three electron beams 6(B, G, R) are emitted along the tube axis, i.e., the Z axis, which corresponds to the central axis of the cylindrical neck portion, which has a circular cross section. The three electron beams 6(B, G, R) emitted from the electron gun assembly 7 are aligned in the horizontal direction perpendicular to the Z axis, i.e., in the H axis direction.

The funnel section 2 is provided with a deflection yoke, and this deflection yoke is on the outer surface of the funnel section 2 and generates a non-uniform deflecting magnetic field. The non-uniform deflecting magnetic field is made up of a pincushion-type horizontal deflecting magnetic field and a barrel-type vertical magnetic field. The former magnetic field is formed in the horizontal direction perpendicular to the Z-axis direction (i.e., the traveling direction of electron beams), that is, it is formed in the H-axis direction. The latter magnetic field is formed in the vertical direction perpendicular to both the tube-axis direction and the horizontal direction, that is, it is formed in the V-axis direction.

In this color cathode ray tube, the in-line electron gun assembly 7 is arranged in such a manner that, in the main lens section thereof, the side beam passage holes formed in a low-voltage grid are decentered from those formed in a high-voltage grid. With this structure, the three electron beams are converged on the center of the phosphor screen 3. The three electron beams 6B, 6G and 6R emitted from the electron gun assembly 7 are deflected in both the horizontal and vertical directions by the non-uniform magnetic field generated by the deflecting yoke. The electron beams pass through the shadow mask 4 and scan the entire area of the phosphor screen 3 in both the horizontal and vertical directions, while simultaneously self-converging. In this manner, a color image is displayed.

Figure 11A:
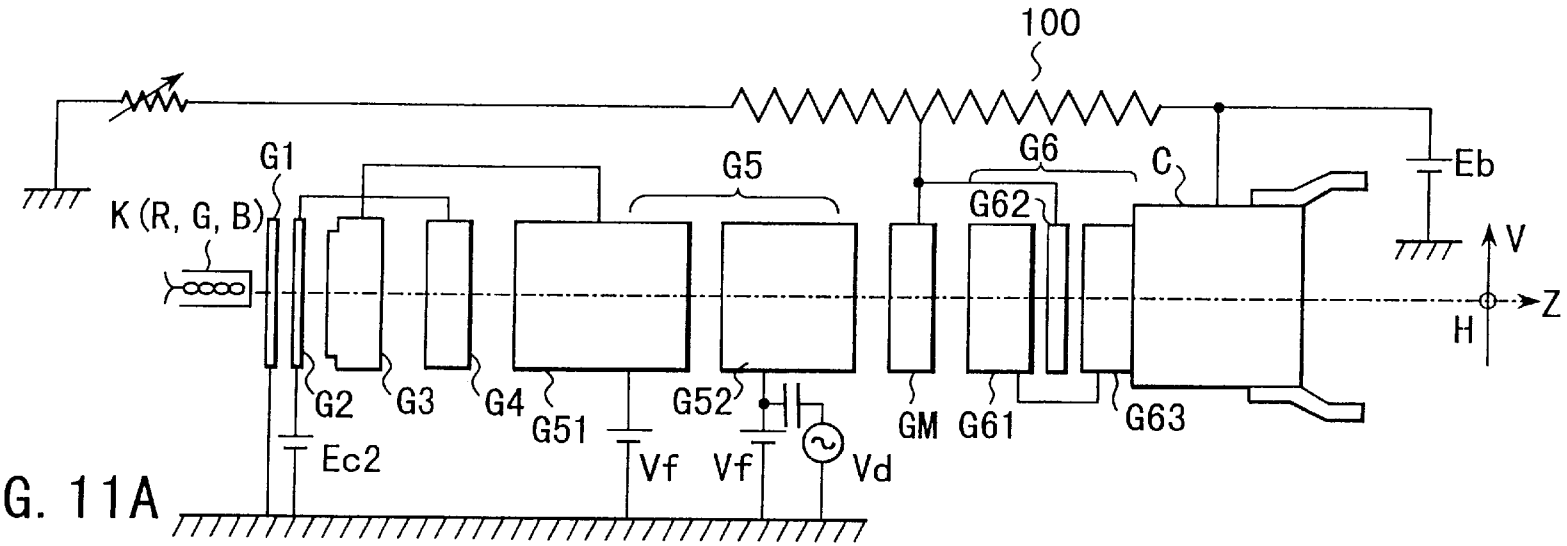
FIG. 11A is a vertical section view schematically showing the structure of an electron gun assembly which is applied to the color cathode ray tube shown in FIG. 8.

FIG. 11A is a section view schematically showing the structure of an electron gun assembly applied to the cathode ray-tube of the embodiment of the present invention.

As shown in FIG. 11A, the electron gun assembly comprises: three cathodes K(B, G, R) incorporating a heater (not shown); a first grid G1, a second grid G2, a third grid G3, a fourth grid G4, a fifth grid G5, an intermediate electrode GM, a sixth grid G6, and a convergence cup C. The cathodes, the grids and the electrodes are arranged in the order mentioned, and are supported and fixed by means of an insulative support member (not shown).

The three cathodes K(B, G, R) are arranged in the horizontal direction.

The first grid G1 is a thin plate-like electrode and has three small-diameter electron beam passage holes. The second grid G2 is a thin plate-like electrode and has three small-diameter electron beam passage holes. The third grid G3 is made up of one cup-shaped electrode and a thick plate electrode. The third grid G3 has three electron beam passage holes that are formed in the surface facing the second grid G2. The diameters of these holes are somewhat larger than those of the electron beam passage holes formed in the second grid G2. The third grid G3 also has three large-diameter electron beam passage holes that are formed in the surface facing the fourth grid G4. The fourth grid G4 is made by coupling the open-end portions of two cup-shaped electrodes against each other. The fourth grid G4 has three large-diameter electron beam passage holes formed in the surface facing the third grid G3 and three large-diameter electron beam passage holes formed in the surface facing the fifth grid G5.

Figure 12A:
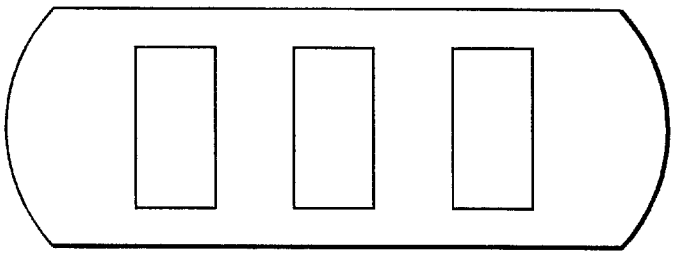
FIGS. 12A–12E shows the structures of the electrodes constituting the main electronic lens section of the electron gun assembly shown in FIG. 11A.

The fifth grid G5 has a first segment G51 and a second segment G52 arranged in the Z-axis direction. The first segment G51 is close to the fourth grid G4, and the second segment G52 is close to the intermediate electrode GM. The first segment G51 is made by coupling the open-end portions of two cup-shaped electrodes which are long in the Z-axis direction against each other. The first segment G51 has three large-diameter electron beam passage holes formed in the surface facing the fourth grid G4. It also has three electron beam passage holes formed in the surface facing the second segment G52 and elongated in the V-axis direction, as shown in FIG. 12A.

Figure 12B:
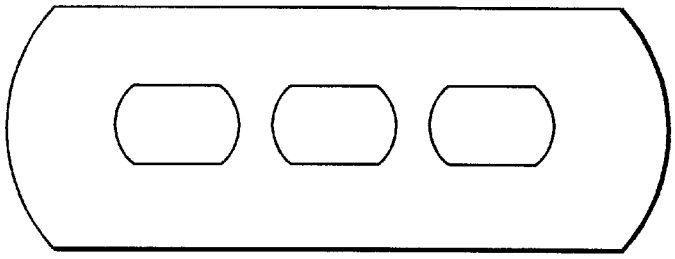

The second segment G52 has three electron beam passage holes formed in the surface facing the first grid G51 and elongated in the H-axis direction, as shown in FIG. 12B. The second segment G52 also has three electron beam passage holes which are formed in the surface facing the intermediate electrode GM and which are substantially circular, as shown in FIG. 12C.

Figure 12C:
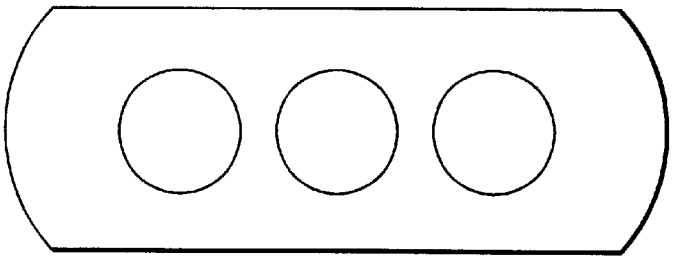

The intermediate electrode GM is a thick plate electrode and has three electron beam passage holes, which are substantially circular, as shown in FIG. 12C.

The sixth grid G6 comprises a first anode G61, an auxiliary electrode G62, and a second anode G63. These are arranged in the Z-axis direction from the side of the cathode K in the order mentioned. The first anode G61 includes: a thick plate electrode having three electron beam passage holes which are formed in the surface facing the intermediate electrode GM and which are substantially circular, as shown in FIG. 12C; and a plate electrode arranged close to the auxiliary electrode G62 of the thick plate electrode and having three electron beam passage holes which are elongated in the H-axis direction, as shown in FIG. 12B.

The auxiliary electrode G62 is a plate-like electrode and has three electron beam passage holes, which are substantially circular, as shown in FIG. 12C. The second anode G63 includes a plate-like electrode arranged on the surface facing the auxiliary electrode G62, and has three electron beam passage holes which are elongated in the H-axis direction, as shown in FIG. 12B. The second anode G63 includes a convergence cup arranged on the surface close to the phosphor screen.

As shown in FIG. 11A, the three cathodes K(B, G, R) of the electron gun assembly are applied with voltage EK, which is in the range of about 100V to 150V. The first grid G1 is grounded. The second and fourth grids G2 and G4 are connected together inside the tube, and are applied with voltage EC2, which is in the range of about 600V to 800V. The third grid G3 and the first segment G51 of the fifth grids G3 and G5 are connected together inside the tube, and are applied with a focusing voltage Vf, which is a fixed intermediate voltage in the range of about 6KV to 9KV.

The second segment G52 of the fifth grid G5 is applied with a focusing voltage (Vf+Vd) in the range of about 6 KV to 9 KV. The focusing voltage is a voltage obtained by superimposing fixed intermediate voltage Vf with voltage Vd, which varies parabolically in accordance with the amount of deflection of an electron beam.

The first and second anodes G61 and G63 of the sixth grid G6 are connected together in the tube, and applied with anode voltage Eb, which is in the range of about 25 KV to 30 KV. The intermediate electrode GM and the auxiliary electrode G62 of the sixth grid G6 are connected together inside the tube, and applied with an intermediate voltage through a resistor 100. The intermediate voltage is higher than the focusing voltage applied to the second segment G52 and lower than the anode voltage applied to the first anode G61.

In the lens system described above, the intermediate electrode GM serves to expand an electric field between the second segment G52 of the fifth grid G5 and the first anode G61 of the sixth grid G6. The lens system forms a main electron lens section ML and thus constitutes a long-focal-length and large-diameter lens. Owing to this structure, a very tiny beam spot can be formed on the screen.

Figure 11B:
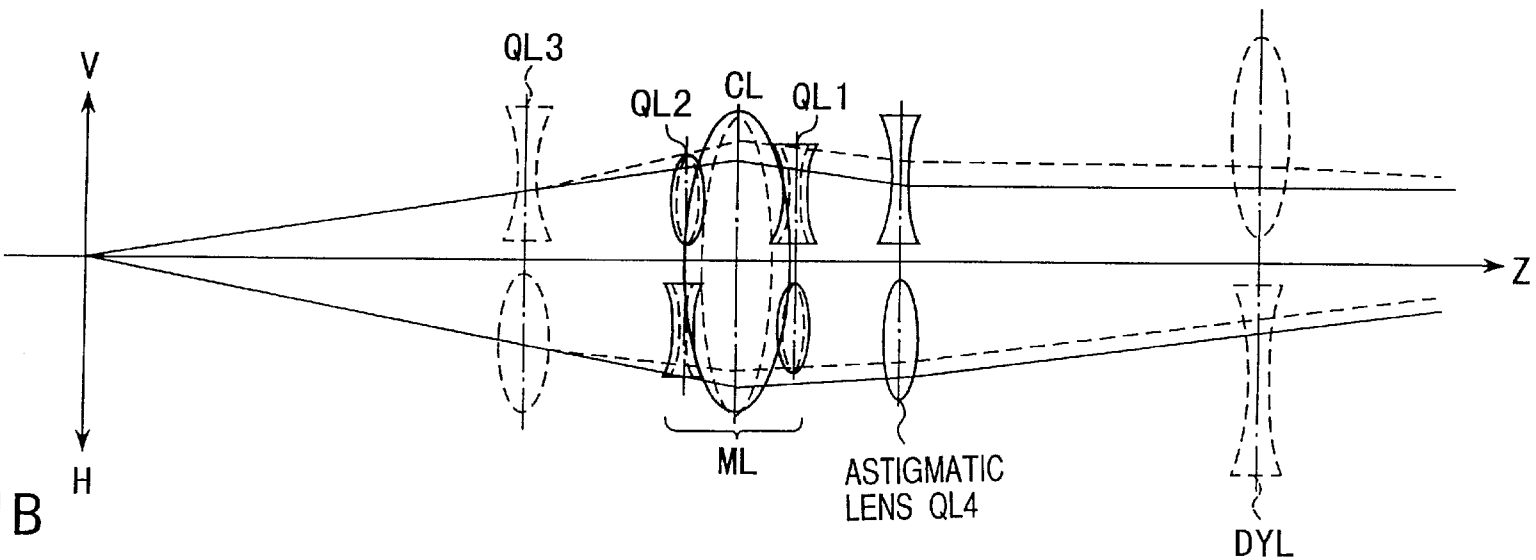
FIG. 11B is a view illustrating the lens function of the electron gun assembly shown in FIG. 11A.

FIG. 11B is a view schematically illustrating the main lens section which the fifth to sixth grids G5 and G6 form when voltages are applied in the manner shown in FIG. 11A. In FIG. 11B, the solid lines indicate how the electron beam paths and the lens functions are in the non-deflection mode when electron beams are focused on the center of the phosphor screen. The broken lines indicate how the electron beam paths and the lens functions are in the deflection mode when electron beams are deflected toward the periphery of the phosphor screen.

As indicated by the solid lines in FIG. 11B, in the non-deflection mode, the main electron lens section ML has a quadrupole lens section QL2 formed between the second segment G52 and the intermediate electrode GM, and another quadrupole lens section QL1 formed between the intermediate electrode GM and the first anode G61.

The quadrupole lens section QL2 is formed at the electron beam input portion of the main electron lens section ML, and is relatively made up of a focusing vertical component and a diverging horizontal component. The quadrupole lens section QL1 is formed at the electron beam output portion of the main electron lens section ML, and is relatively made up of a diverging vertical component and a focusing horizontal component.

In addition, the first anode G61, the auxiliary electrode G62 and the second anode G63 form a quadrupole lens section QL4 in the neighborhood of the deflection yoke lens DYL serving as a lens for generating a deflection magnetic field. The quadrupole lens section QL4 has a vertical-direction component with a diverging effect, and a horizontal-direction component with a focusing effect.

As indicated by the broken lines in FIG. 11B, in the deflection mode, voltage Vd, which varies parabolically in accordance with the amount of deflection of an electron beam, is superimposed on the voltage applied to the second segment G52. As a result, a quadrupole lens QL3 is formed between the first segment G51 and the second segment G52, and the quadrupole lens QL3 has a vertical-direction component with a diverging effect, and a horizontal-direction component with a focusing effect. In this mode, the lens power of the quadrupole lens sections QL1 and QL2 is weaker than that in the non-deflection mode.

As shown in FIG. 11A, one intermediate electrode GM is interposed between the second segment G52 of the fifth grid G5, to which an intermediate focusing voltage varying in synchronism with a deflecting magnetic field, and the first anode G61 to which an anode voltage is applied. The intermediate electrode GM is applied with a voltage that has a middle level between the level of the intermediate focusing voltage and the level of the anode voltage. These three electrodes constitute a main lens section ML of an electric field expansion type.

At least one auxiliary electrode G62 is arranged between the first anode G61 of the electric field expansion type main lens section ML and the second anode G63. This second anode G63 is located closer to the screen than the first anode G61, as viewed in the traveling direction of electron beams, and is applied with an anode voltage. The auxiliary electrode G62 and the intermediate electrode GM are electrically connected together. For the sake of simplicity, reference was made to the case where only one intermediate electrode is provided. Needless to say, a number of intermediate electrodes may be provided.

With the structure described above, it is possible to reduce the percentage of the AC voltage component Vd, which is applied to the second segment G52 serving as a focusing electrode, with respect to the voltage applied to the intermediate electrode GM. In short, the percentage of superimposition can be reduced. As described in relation to the first embodiment, a reliable beam spot shape can be formed at any portion of the entire screen.

Owing to the operation of the quadrupole lens section QL3 in the electron beam deflection mode, the lens main plane as viewed in the horizontal direction moves backward toward the cathode, while the lens main plane as viewed in the vertical direction moves forward toward the screen. As a result, an angular magnification difference is caused between the vertical and horizontal directions, and a horizontally elongated beam is formed on the periphery of the screen. The angular magnification difference between the vertical and horizontal directions is considered to increase in accordance with an increase in the lens power of the quadrupole lens QL3. This phenomenon is attributed to the fact that the distances for which the lens main plane moves in the horizontal and vertical directions are dependent on the horizontal-direction component of the quadrupole lens QL3 (i.e., the focusing effect) and the vertical-direction component thereof (i.e., the diverging effect).

As described above, the lens power of the quadrupole lens QL3 is intended to compensate for the insufficient diverging effect in the vertical direction and the insufficient focusing effect in the horizontal direction, which insufficiencies are caused by the superimposition of the AC voltage component Vd on the voltage applied to the intermediate electrode of the main lens section. This means that if the percentage of superimposition regarding the AC voltage component Vd applied to the intermediate electrode can be decreased, the lens power of the quadrupole lens QL3 need not be as intense as that of the conventional art.

In other words, the distances for which the lens main section moves in the horizontal and vertical directions can be shortened and the angular magnification difference between the vertical and horizontal directions can be decreased by weakening the lens power of the quadrupole lens section QL3. Hence, the electron beam spot is prevented from being excessively elongated in the horizontal direction on the periphery of the screen.

As can be seen from this, the horizontal elongation of the electron beam on the periphery of the screen can be suppressed by decreasing the percentage of superimposition of the AC voltage component Vd applied to the intermediate electrode.

According to the present invention, the means for decreasing the percentage of superimposition of the AC voltage component Vd applied to the intermediate electrode is realized by the structure below.

The conventional electron gun assembly has such an electrode structure as is shown in FIG. 10A. The equivalent circuit of this electrode structure is shown in FIG. 10B. Assuming that the capacitance between the focusing electrode G52 and the intermediate electrode GM is equal to that between the intermediate electrode GM and the sixth grid G6, 50% of the AC voltage component Vd applied to the focusing electrode G52 is superimposed on the voltage applied to the intermediate electrode GM. In contrast to this, the electrode structure according to the present invention, which is shown in FIG. 9A, has such an equivalent circuit as is shown in FIG. 9B. Assuming that the capacitances between the electrodes are equal, 25% of the AC voltage component Vd applied to the intermediate electrode GM is superimposed. This means that the percentage of superimposition can be reduced to half in comparison with the percentage of superimposition of the conventional electron gun assembly.

In this manner, it is possible to suppress the insufficiency of the diverging effect in the vertical direction and the insufficiency of the focusing effect in the horizontal direction, which insufficiencies are caused by the superimposition of the AC voltage component Vd on the voltage applied to the intermediate electrode GM of the main lens section ML. In addition, the quadrupole lens QL3, which is formed for compensating for the insufficiencies in the lens power, need not have an intense lens power. This being so, the lens main plane as viewed in the horizontal direction does not move backward toward the cathode, and the lens main plane as viewed in the vertical direction does not move forward toward the screen. Hence, the angular magnification difference between the vertical and horizontal directions can be reduced, and the horizontal elongation of a beam spot can be suppressed on the periphery of the screen.

As shown in FIG. 11B, an asymmetric lens QL4 is formed by the first anode lens G61, the second anode G63, and the auxiliary electrode G62. The first anode G61 is for forming a main lens section ML of an electric field expansion type, the second anode G63 is located closer to the screen than the first anode G61, as viewed in the traveling direction of electron beams. The auxiliary electrode G62 is located between the first and second anodes G61 and G63 and is electrically connected to the intermediate electrode GM. The asymmetric lens QL4 has a vertical-direction component with a diverging effect, and a horizontal-direction component with a focusing effect. The asymmetric lens QL4 is arranged in the neighborhood of a deflection yoke lens DYL.

As described above in relation to the means for solving the problems, the vertical-direction component of the deflection yoke lens DYL has a strong focusing effect and the horizontal-direction component thereof has a strong diverging effect, when an electron beam is deflected toward the periphery of the screen. Since these components can be effectively corrected, the vertical diameter of a beam spot formed on the periphery of the screen does not excessively decrease and the horizontal diameter thereof does not excessively increase. As a result, the beam spot can be as circular as possible.

A description will now be given of the third embodiment of the present invention.

Like the second embodiment, the cathode ray tube of the third embodiment is an in-line color cathode ray tube. As shown in FIG. 10A, the electron gun assembly applied to the color cathode ray tube comprises: three cathodes K(B, G, R) incorporating a heater (not shown); a first grid G1, a second grid G2, a third grid G3, a fourth grid G4, a fifth grid G5, an intermediate electrode GM, a sixth grid G6, and a convergence cup C. The cathodes, the grids and the electrodes are arranged in the order mentioned, and are supported and fixed by means of an insulative support member (not shown).

The three cathodes K(B, G, R) are arranged in the horizontal direction.

The first grid G1 is a thin plate-like electrode and has three small-diameter electron beam passage holes. The second grid G2 is a thin plate-like electrode and has three small-diameter electron beam passage holes. The third grid G3 is made up of one cup-shaped electrode and a thick plate electrode. The third grid G3 has three electron beam passage holes that are formed in the surface facing the second grid G2. The diameters of these holes are somewhat larger than those of the electron beam passage holes formed in the second grid G2. The third grid G3 also has three large-diameter electron beam passage holes that are formed in the surface facing the fourth grid G4. The fourth grid G4 is made by coupling the open-end portions of two cup-shaped electrodes against each other. The fourth grid G4 has three large-diameter electron beam passage holes formed in the surface facing the third grid G3 and three large-diameter electron beam passage holes formed in the surface facing the fifth grid G5.

The fifth grid G5 has a first segment G51 and a second segment G52 arranged in the Z-axis direction. The first segment G51 is close to the fourth grid G4, and the second segment G52 is close to the intermediate electrode GM. The first segment G51 is made by coupling the open-end portions of two cup-shaped electrodes which are long in the Z-axis direction against each other. The first segment G51 has three large-diameter electron beam passage holes formed in the surface facing the fourth grid G4. It also has three electron beam passage holes formed in the surface facing the second segment G52 and elongated in the V-axis direction, as shown in FIG. 12A.

The second segment G52 has three electron beam passage holes formed in the surface facing the first grid G51 and elongated in the H-axis direction, as shown in FIG. 12B. The second segment G52 also has three electron beam passage holes which are formed in the surface facing the intermediate electrode GM and which are substantially circular, as shown in FIG. 12C.

The intermediate electrode GM is a thick plate electrode and has three electron beam passage holes, which are substantially circular, as shown in FIG. 12C.

The sixth grid G6 comprises a first anode G61, an auxiliary electrode G62, and a second anode G63. These are arranged in the Z-axis direction from the side of the cathode K in the order mentioned. The first anode G61 includes: a thick plate electrode having three electron beam passage holes which are formed in the surface facing the intermediate electrode GM and which are substantially circular, as shown in FIG. 12C; and a plate electrode arranged close to the auxiliary electrode G62 of the thick plate electrode and having three electron beam passage holes which are elongated in the H-axis direction, as shown in FIG. 12B.

Figure 12D:
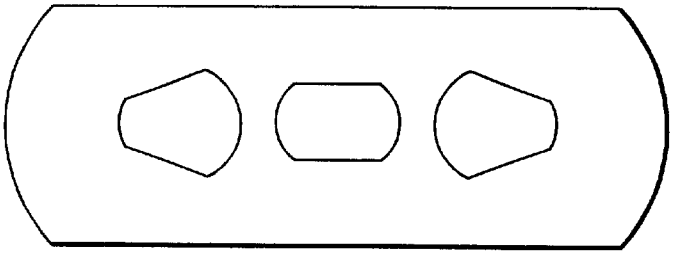

The auxiliary electrode G62 is a plate-like electrode and has three electron beam passage holes, which are substantially circular, as shown in FIG. 12C. The second anode G63 includes a plate-like electrode arranged on the surface facing the auxiliary electrode G62, and has such three electron beam passage holes as are shown in FIG. 12D. Of the three electron beam passage holes, the center beam passage hole, through which a center beam passes, is elongated in the H-axis direction. The side beam passage holes, through which side beams pass, have large vertical diameters at positions close to the center beam passage hole and have small vertical diameters at positions far from the center beam passage hole. The second anode G63 has a convergence cup arranged on the surface closer to the phosphor screen.

As shown in FIG. 11A, the three cathodes K(B, G, R) of the electron gun assembly are applied with voltage EK, which is in the range of about 100V to 150V. The first grid G1 is grounded. The second and fourth grids G2 and G4 are connected together inside the tube, and are applied with voltage EC2, which is in the range of about 600V to 800V. The third grid G3 and the first segment G51 of the fifth grid G5 are connected together inside the tube, and are applied with a focusing voltage Vf, which is a fixed intermediate voltage in the range of about 6 KV to 9 KV.

The second segment G52 of the fifth grid G5 is applied with a focusing voltage (Vf+Vd) in the range of about 6 KV to 9 KV. The focusing voltage is a voltage obtained by superimposing fixed intermediate voltage Vf with voltage Vd, which varies parabolically in accordance with the amount of deflection of an electron beam.

The first and second anodes G61 and G63 of the sixth grid G6 are connected together in the tube, and applied with anode voltage Eb, which is in the range of about 25 KV to 30 KV. The intermediate electrode GM and the auxiliary electrode G62 of the sixth grid G6 are connected together inside the tube, and applied with an intermediate voltage through a resistor 100. The intermediate voltage is higher than the focusing voltage applied to the second segment G52 and lower than the anode voltage applied to the first anode G61.

In the lens system described above, the intermediate electrode GM serves to expand an electric field between the second segment G52 of the fifth grid G5 and the first anode G61 of the sixth grid G6. The lens system forms a main electron lens section ML and thus constitutes a long-focal-length and large-diameter lens. Owing to this structure, a very tiny beam spot can be formed on the screen.

FIG. 11B is a view schematically illustrating the main lens section which the fifth to sixth grids G5 and G6 form when voltages are applied in the manner shown in FIG. 11A. In FIG. 11B, the solid lines indicate how the electron beam paths and the lens functions are in the non-deflection mode when electron beams are focused on the center of the phosphor screen. The broken lines indicate how the electron beam paths and the lens functions are in the deflection mode when electron beams are deflected toward the periphery of the phosphor screen.

As indicated by the solid lines in FIG. 11B, in the non-deflection mode, the main electron lens section ML has a quadrupole lens section QL2 formed between the second segment G52 and the intermediate electrode GM, and another quadrupole lens section QL1 formed between the intermediate electrode GM and the first anode G61.

The quadrupole lens section QL2 is formed at the electron beam input portion of the main electron lens section ML, and is made up of a focusing vertical component and a diverging horizontal component. The quadrupole lens section QL1 is formed at the electron beam output portion of the main electron lens section ML, and is made up of a diverging vertical component and a focusing horizontal component.

In addition, the first anode G61, the auxiliary electrode G62 and the second anode G63 form a quadrupole lens section QL4 in the neighborhood of the deflection yoke lens DYL serving as a lens for generating a deflection magnetic field. The quadrupole lens section QL4 has a vertical-direction component with a diverging effect, and a horizontal-direction component with a focusing effect.

As indicated by the broken lines in FIG. 11B, in the deflection mode, voltage Vd, which varies parabolically in accordance with the amount of deflection of an electron beam, is superimposed on the voltage applied to the second segment G52. As a result, a quadrupole lens QL3 is formed between the first segment G51 and the second segment G52, and the quadrupole lens QL3 has a vertical-direction component with a diverging effect, and a horizontal-direction component with a focusing effect. In this mode, the lens power of the quadrupole lens sections QL1 and QL2 is weaker than that in the non-deflection mode.

As shown in FIG. 11A, one intermediate electrode GM is interposed between the second segment G52 of the fifth grid G5, to which an intermediate focusing voltage varying in synchronism with a deflecting magnetic field, and the first anode G61 to which an anode voltage is applied. The intermediate electrode GM is applied with a voltage that has a substantially middle level between the level of the intermediate focusing voltage and the level of the anode voltage. These three electrodes constitute a main lens section ML of an electric field expansion type.

At least one auxiliary electrode G62 is arranged between the first anode G61 of the electric field expansion type main lens section ML and the second anode G63. This second anode G63 is located closer to the screen than the first anode G61, as viewed in the traveling direction of electron beams, and is applied with an anode voltage. The auxiliary electrode G62 and the intermediate electrode GM are electrically connected together. For the sake of simplicity, reference was made to the case where only one intermediate electrode is provided. Needless to say, a number of intermediate electrodes may be provided.

With the structure described above, it is possible to reduce the percentage of the AC voltage component Vd, which is applied to the second segment G52 serving as a focusing electrode, with respect to the voltage applied to the intermediate electrode GM. In short, the percentage of superimposition can be reduced. As described in relation to the first embodiment, a reliable beam spot shape can be formed at any portion of the entire screen.

Owing to the operation of the quadrupole lens section QL3 in the electron beam deflection mode, the lens main plane as viewed in the horizontal direction moves backward toward the cathode, while the lens main plane as viewed in the vertical direction moves forward toward the screen. As a result, an angular magnification difference is caused between the vertical and horizontal directions, and a horizontally elongated beam is formed on the periphery of the screen. The angular magnification difference between the vertical and horizontal directions is considered to increase in accordance with an increase in the lens power of the quadrupole lens QL3. This phenomenon is attributed to the fact that the distances for which the lens main plane moves in the horizontal and vertical directions are dependent on the horizontal-direction component of the quadrupole lens QL3 (i.e., the focusing effect) and the vertical-direction component thereof (i.e., the diverging effect).

As described above, the lens power of the quadrupole lens QL3 is intended to compensate for the insufficient diverging effect in the vertical direction and the insufficient focusing effect in the horizontal direction, which insufficiencies are caused by the superimposition of the AC voltage component Vd on the voltage applied to the intermediate electrode of the main lens section. This means that if the percentage of superimposition regarding the AC voltage component Vd applied to the intermediate electrode can be decreased, the lens power of the quadrupole lens QL3 need not be as intense as that of the conventional art.

In other words, the distances for which the lens main section moves in the horizontal and vertical directions can be shortened and the angular magnification difference between the vertical and horizontal directions can be decreased by weakening the lens power of the quadrupole lens section QL3. Hence, the electron beam spot is prevented from being excessively elongated in the horizontal direction on the periphery of the screen.

As can be seen from this, the horizontal elongation of the electron beam on the periphery of the screen can be suppressed by decreasing the percentage of superimposition of the AC voltage component Vd applied to the intermediate electrode.

According to the present invention, therefore, the means for decreasing the percentage of superimposition of the AC voltage component Vd applied to the intermediate electrode is realized by the structure described above.

The conventional electron gun assembly has such an electrode structure as is shown in FIG. 10A. The equivalent circuit of this electrode structure is shown in FIG. 10B. Assuming that the capacitance between the focusing electrode G5 and the intermediate electrode GM is equal to that between the intermediate electrode GM and the sixth grid G6, 50% of the AC voltage component Vd applied to the focusing electrode G5 is superimposed on the voltage applied to the intermediate electrode GM. In contrast to this, the electrode structure according to the present invention, which is shown in FIG. 9A, has such an equivalent circuit as is shown in FIG. 9B. Assuming that the capacitances between the electrodes are equal, 25% of the AC voltage component Vd applied to the intermediate electrode GM is superimposed. This means that the percentage of superimposition can be reduced to half in comparison with the percentage of superimposition of the conventional electron gun assembly.

In this manner, it is possible to suppress the insufficiency of the diverging effect in the vertical direction and the insufficiency of the converging effect in the horizontal direction, which insufficiencies are caused by the superimposition of the AC voltage component Vd on the voltage applied to the intermediate electrode GM of the main lens section ML. In addition, the quadrupole lens QL3, which is formed for compensating for the insufficiencies in the lens power, need not have an intense lens power. This being so, the lens main plane as viewed in the horizontal direction does not move backward toward the cathode, and the lens main plane as viewed in the vertical direction does not move forward toward the screen. Hence, the angular magnification difference between the vertical and horizontal directions can be reduced, and the horizontal elongation of a beam spot can be suppressed on the periphery of the screen.

As shown in FIG. 11B, an asymmetric lens QL4 is formed by the first anode lens G61, the second anode G63, and the auxiliary electrode G62. The first anode G61 is for forming a main lens section ML of an electric field expansion type, the second anode G63 is located closer to the screen than the first anode G61, as viewed in the traveling direction of electron beams. The auxiliary electrode G62 is located between the first and second anodes G61 and G63. The asymmetric lens QL4 has a vertical-direction component with a diverging effect, and a horizontal-direction component with a focusing effect. The asymmetric lens QL4 is arranged in the neighborhood of a deflection yoke lens DYL.

As described above in relation to the second embodiment, the vertical-direction component of the deflection yoke lens DYL has a strong focusing effect and the horizontal-direction component thereof has a strong diverging effect, when an electron beam is deflected toward the periphery of the screen. Since these components can be effectively corrected, the vertical diameter of a beam spot formed on the periphery of the screen does not excessively decrease and the horizontal diameter thereof does not excessively increase. As a result, the beam spot can be as circular as possible.

Figure 14:
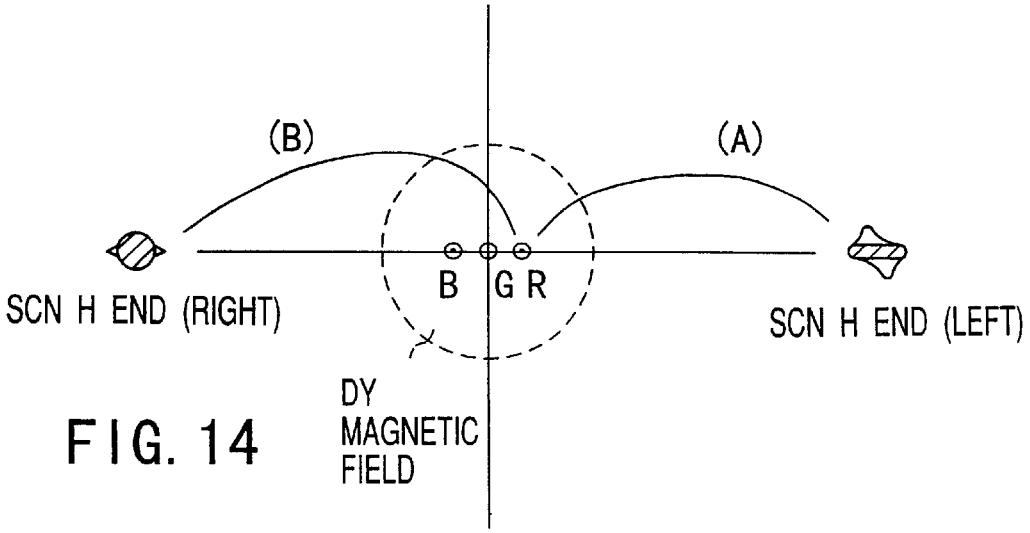
FIG. 14 shows where in a deflection magnetic field a side beam (R) passes, as well as the shapes of beam spots formed on the periphery of a screen.

The present embodiment is designed to cope with the problem of a color cathode ray tube whose deflection angle is wide. In this type of cathode ray tube, the deflecting magnetic field inevitably includes a coma aberration component, and the beam spot shape on the left side of the screen and that on the right side thereof may be different, as shown in FIG. 14. The present embodiment has solved this problem by arranging the asymmetric lens in the neighborhood of the deflection yoke lens DYL. With this structure, preliminary deflection by the deflecting magnetic field is made to take place inside the asymmetric lens. The asymmetric lens has different effects on the center beam and the side beams. As shown in FIGS. 14 and 15A–15D, the lens effect on the side beams acts such that the divergence of electron beams is stronger in the case (FIG. 15A) where the preliminary deflection by the deflecting magnetic field causes the side beams to travel along paths far way from the center beam than in the case (FIG. 15B) where the preliminary deflection by the deflecting magnetic field causes the side beams to travel along paths close to the center beam.

Figure 15A:
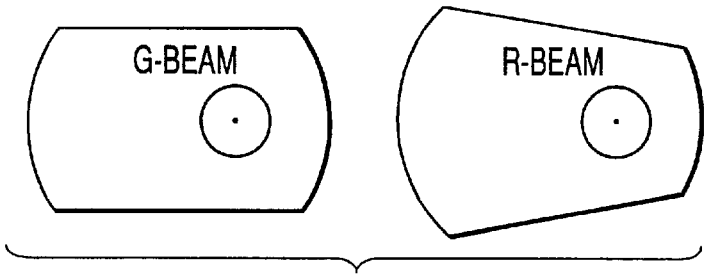
FIG. 15A illustrates the case where the side beam (R) passes along the path indicated by (A) in FIG. 14, and shows how the position of that side beam is related to the electron beam passage hole formed in the second anode as viewed from the auxiliary electrode.
Figure 15C:
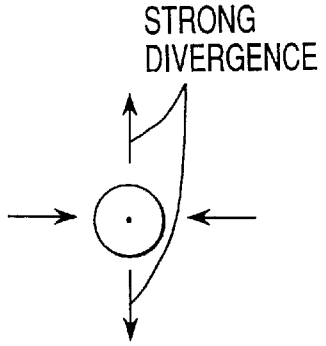
FIG. 15B illustrates the case where the side beam (R) passes along the path indicated by (B) in FIG. 14, and shows how the position of that side beam is related to the electron beam passage hole formed in the second anode as viewed from the auxiliary electrode, FIG. 15C schematically illustrates the lens effect exerted on the side beam (R) in the case shown in FIG. 15A, and FIG. 15D schematically illustrates the lens effect exerted on the side beam (R) in the case shown in FIG. 15B.
Figure 15B:
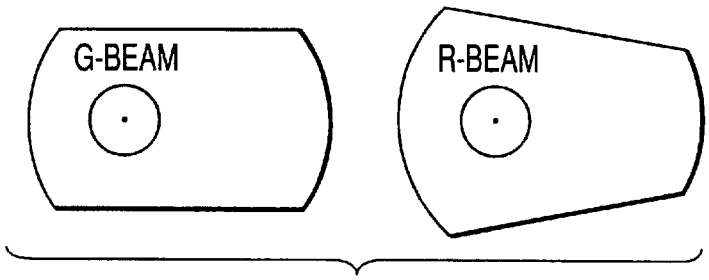
Figure 15D:
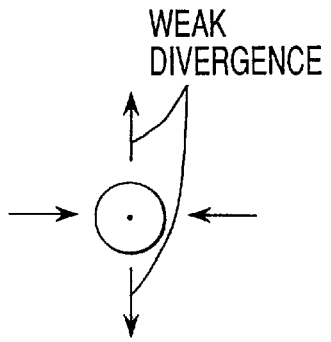

A more detailed description will be given with reference to the Figures. FIGS. 15A and 15B show electron beam passage holes that are formed in that surface of the second anode G63 which faces the auxiliary electrode G62, and also show how a center beam (G) and a side beam (R) are positioned in the respective holes when viewed from the screen. FIGS. 15C and 15D show the vertical diverging effect and horizontal focusing effect which the side beam undergoes. When the side beam (R) travels along the path indicated by (A) in FIG. 14, it passes through the electron beam passage hole formed in that surface of the second anode G63 which faces the auxiliary electrode G62, in such a manner as is shown in FIG. 15A. The lens effect which the side beam (R) may undergo then is shown in FIG. 15C.

When the side beam (R) travels along the path indicated by (B) in FIG. 14, it passes through the electron beam passage hole formed in that surface of the second anode G63 which faces the auxiliary electrode G62, in such a manner as is shown in FIG. 15B. The lens effect which the side beam (R) may undergo then is shown in FIG. 15D.

When the side beam passes along the path indicated by (A) in FIG. 14, it is excessively focused in the vertical direction and insufficiently focused in the horizontal direction on the periphery of the screen. In order to correct the vertical excessive focusing effect and the horizontal insufficient focusing effect, the side beam (R) is made to pass through the electron beam passage hole formed in that surface of the second anode G63 which faces the auxiliary electrode G62, in such a manner as is shown in FIG. 15A. As shown, the side beam passes through the hole region having a small vertical diameter. Owing to this, the side beam is intensely diverged in the vertical direction and intensely focused in the horizontal direction, as shown in FIG. 15C.

When the side beam passes along the path indicated by (B) in FIG. 14, it is insufficiently focused in the vertical direction and excessively focused in the horizontal direction on the periphery of the screen. In order to correct the vertical insufficient focusing effect and the horizontal excessive focusing effect, the side beam (R) is made to pass through the electron beam passage hole formed in that surface of the second anode G63 which faces the auxiliary electrode G62, in such a manner as is shown in FIG. 15B. As shown, the side beam passes through the hole region having a large vertical diameter. Owing to this, as shown in FIG. 15D, the side beam is weakly diverged in the vertical direction and weakly focused in the horizontal direction than in the case shown in FIG. 15C.

Figure 12E:
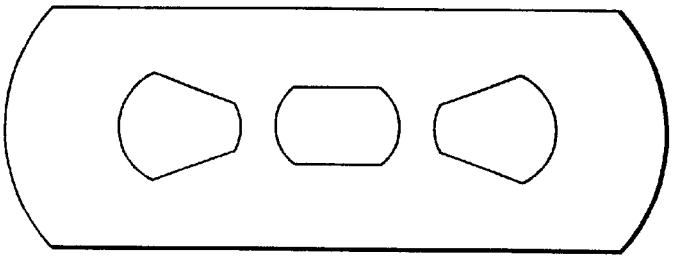
Figure 13A:
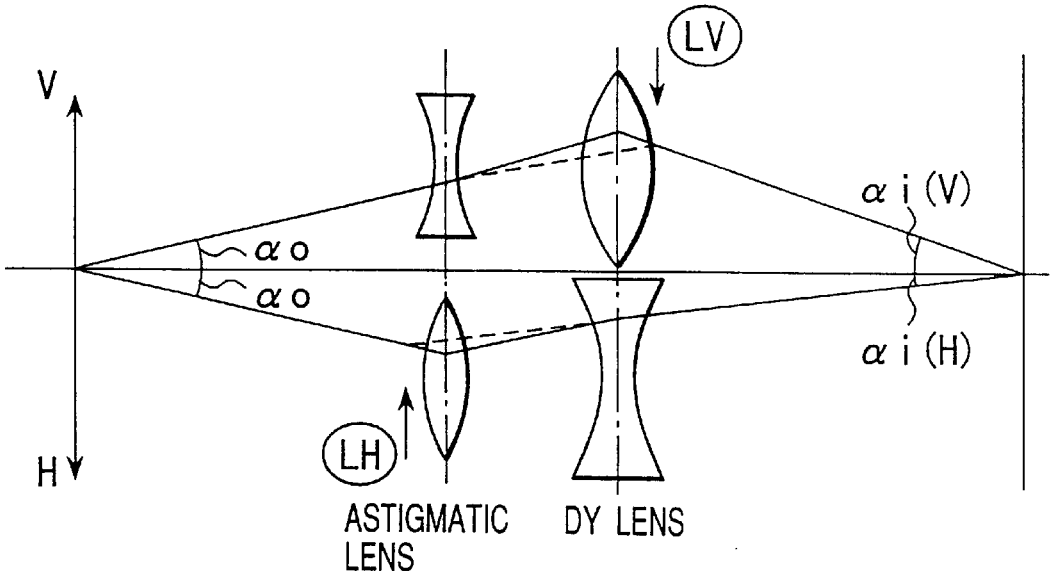
FIGS. 13A and 13B show how the positional relationship between a DY lens and an astigmatic lens is related to the magnification.
Figure 13B:
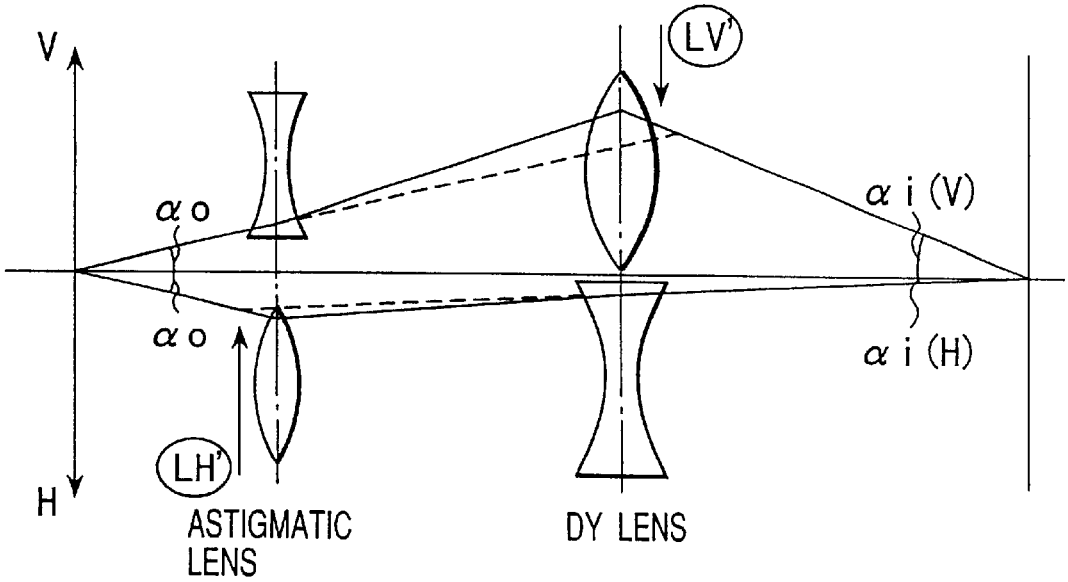
Figure 16:
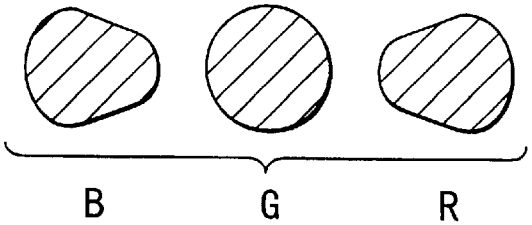
FIG. 16 shows how beam spot shapes formed by side beams according to the third embodiment look like when viewed from the screen, the side beams being subjected to comma aberration.

With this structure, the side beam shape difference between the right and left peripheral portions of the screen can be eliminated. As a result, coma aberration components caused by a deflecting magnetic field, such as the component shown in FIG. 14, can be adequately corrected. According to the prior art, the side beams are focused differently between the right and left portions of the screen, due to the different diverging effects the deflection yoke has on the side beams. Even if an appropriate AC voltage component is applied to the focusing electrode, the electron beam spots cannot be simultaneously focused in an appropriate manner in the right and left portions of the screen. This problem has been solved by the structure described above.

Where the above structure is adopted, the side beams (R) in the center of the screen may become triangular, due to the coma aberration, as shown in FIG. 16. If components attributable to the coma aberration appear, it is possible to employ the following structure. A plate-like electrode having three electron beam passage holes shown in FIG. 12E is arranged on that surface of the first anode G61 which faces the intermediate electrode GM. By means of this structure, it is possible to correct the coma aberration components. As shown in FIG. 12E, the plate-like electrode has a center beam passage hole which is horizontally elongated, and a pair of side beam passage holes which have small vertical diameters at positions close to the center beam passage hole and which increase in vertical diameter in accordance with an increase in the distance from the center beam passage hole. By forming beam passage holes having such shapes, the coma aberrations causing the side beams to become triangular (FIG. 16) can be corrected.

The present invention is not limited to the embodiments described above.

For example, two or more intermediate electrodes may be employed. In this case; the auxiliary electrode G62 of the sixth grid G6 can be electrically connected to any one of the intermediate electrodes, the advantages of the invention are not affected thereby.

In the embodiments described above, the focusing electrode, namely, the fifth grid, is made up of two segments. However, this in no way restricts the present invention, and the focusing electrode may be made up of three or more segments.

As described above, the present invention can provide a cathode ray tube which prevents or suppresses the distortion of a beam spot shape that occur on the periphery of a screen due to the lens magnification difference between the horizontal and vertical directions, and which therefore provides a reliable resolution at any portion of the entire screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube comprising:

an electron gun assembly including: an electron beam formation section for forming and emitting at least one electron beam; and a main electron lens section for accelerating the electron beam and focusing the electron beam on a screen; and a deflection yoke for generating a deflecting magnetic field, with which the electron beam emitted from the electron gun assembly is deflected to the screen in a horizontal direction and a vertical direction, said main electron lens section being an electric field expansion type lens including: a focusing electrode applied with a focusing voltage of a first level; an anode applied with an anode voltage of a second level higher than the first level; and at least one intermediate electrode arranged between the focusing electrode and the anode and applied with an intermediate voltage of a third level which is higher than the first level and lower than the second level, said anode including: a first anode; a second anode located closer to the screen than the first anode as viewed in the traveling direction of electron beams; and at least one auxiliary electrode interposed between the first anode and the second anode, said at least one auxiliary electrode and said at least one intermediate electrode being electrically connected to each other.

2. A cathode ray tube according to claim 1, further comprising means for forming an asymmetric lens section by means of said first anode, said auxiliary electrode and said second anode.

3. A cathode ray tube according to claim 2, wherein said asymmetric lens section includes a horizontal-direction component with a focusing effect and a vertical-direction component with a diverging effect.

4. A cathode ray tube according to claim 2, wherein said electron beam formation section forms at least three electron beams aligned in a horizontal direction and including a center beam and a pair of side beams; and said asymmetric lens section has different lens effects on said center beam and said pair of side beams.

5. A cathode ray tube according to claim 4, wherein said asymmetric lens section includes asymmetric lenses which permit said pair of side beams to pass therethrough, respectively, and said asymmetric lenses provide different lens powers when the three electron beams are deflected toward horizontal end portions of the screen.

6. A cathode ray tube according to claim 5, wherein the asymmetric lenses which permit said pair of side beams to pass therethrough, respectively, act such that diverging effects in the vertical direction are stronger in a case where preliminary deflection by the deflecting magnetic field causes the side beams to travel along paths far away from the center beam than in a case where the preliminary deflection by the deflecting magnetic field causes the side beams to travel along paths close to the center beam.

7. A cathode ray tube according to claim 1, further comprising means for superimposing an AC voltage component, which varies parabolically in accordance with the amount of deflection of an electron beam, on the focusing voltage of the first level applied to the focusing electrode of the main electron lens section.

8. A cathode ray tube according to claim 1, further comprising:

means for forming an asymmetric lens section between the focusing electrode of the main electron lens section and an intermediate electrode located adjacent to the focusing electrode, said asymmetric lens section having a vertical-direction component with a focusing effect and a horizontal-direction component with a diverging effect; and means for forming another an asymmetric lens section between the first anode and an intermediate electrode located adjacent thereto, said another asymmetric lens section having a vertical-direction component with a diverging effect and a horizontal-direction component with a focusing effect.

* * * * *